US008950347B2

(12) United States Patent
Radwan

(10) Patent No.: US 8,950,347 B2
(45) Date of Patent: Feb. 10, 2015

(54) PERFORMANCE OAR

(71) Applicant: Adel Radwan, Toms River, NJ (US)

(72) Inventor: Adel Radwan, Toms River, NJ (US)

( * ) Notice: Subject to any disclaimer, the term of this patent is extended or adjusted under 35 U.S.C. 154(b) by 0 days.

(21) Appl. No.: 13/766,353

(22) Filed: Feb. 13, 2013

(65) Prior Publication Data

US 2014/0227919 A1 Aug. 14, 2014

(51) Int. Cl.
*B63H 16/04* (2006.01)
*B63H 16/067* (2006.01)

(52) U.S. Cl.
CPC ..... *B63H 16/067* (2013.01); *B63H 16/04* (2013.01)
USPC ..... 114/104; 114/106

(58) Field of Classification Search
CPC ..... B63H 16/06
USPC ..... 440/101–110; 416/69, 70 R
See application file for complete search history.

(56) References Cited

U.S. PATENT DOCUMENTS 1,021,721 A * 3/1912 Keddy ..... 440/106
2,995,763 A * 8/1961 Rounds ..... 440/107

* cited by examiner

*Primary Examiner* — Edwin Swinehart
(74) *Attorney, Agent, or Firm* — Alston & Bird LLP

(57) ABSTRACT

This invention relates to an apparatus and method for rowing by generating stored energy in stretchable, retracting members and using that stored energy to pull oars back to a neutral position.

8 Claims, 7 Drawing Sheets

PERFORMANCE OAR

FIELD OF THE INVENTION

This invention relates to an apparatus and method for rowing by generating stored energy in stretchable, retracting members and using that stored energy to pull oars back to a neutral position.

BACKGROUND

Over the years, a variety of designs have been created that attempt to maximize the efficiency of moving an oar-powered boat through water. However, in comparison to these previous designs, the invention described herein eliminates both the high cost maintenance and the complicated mechanical arrangements associated with other systems, which add to the weight to the boat and complexity to the system. While other systems use push-pull mechanisms or complex gearing, this invention uses stretchable, retracting members such as springs or elastic cords to store energy and release it to aid a rower's stroke. Furthermore, other front-facing systems have oar configurations which create many problems including restricting the motion of the oars. Finally, systems which use a rack-and-pinion type of gear drive require excessive maintenance and frequent replacement, which can be very costly.

Other inventions have also recognized the benefit of utilizing springs. However, those inventions are easily distinguishable from the present invention. For example, U.S. Pat. No. 88,013 ("the '013 patent") discloses a boat-oar that will necessarily "feather" as it is thrown or pushed out of the water, and the boat is propelled in the same direction faced by the oarsmen. The '013 patent utilized a spring attached to the oar to aid the oarsman in raising the oar from the water, but specifically stated that the spring must not be attached to the end of the oar, but rather should be attached roughly one-third of the distance toward the handle.

DEFINITIONS

As used herein, stretchable, retracting members include any devices such as springs or elastic materials (such as elastic cords or bungee cords) or any other devices that can be repeatedly stretched and will return to approximately their unstretched length. The invention is not intended to be limited to any particular stretchable, retracting members and is intended to be used with any stretchable, retracting members known to those of ordinary skill in the art. It is preferable to use no more than ten stretchable, retracting members on each of the port and starboard sides of the boat.

As used herein, the "forward power stroke" refers to the rower's pushing of the oar handles from the "neutral" position away from his body when the rower is facing the boat's bow and causing the oar blade to move through the water toward the boat's rear or stern, propelling the boat through the water forward in the direction of the bow.

As used herein, the "reverse power stroke" refers to the rower's pulling of the oar handles from the "neutral" position toward his body when the rower is facing the boat's bow and causing the oar blade to move through the water toward the boat's front or bow, propelling the boat through the water in reverse in the direction of the stern.

As used herein, the "return stroke" refers to the movement of the oar assisted by the stretchable retracting member toward the neutral position. The return stroke is caused by the release of stored energy from the stretchable, retracting member. Once the rower has completed a forward power stroke or a reverse power stroke and raised the oar blade out of the water, the stretchable, retracting members release stored energy generated by the forward power stroke or reverse power stroke, pulling the oar back to the "neutral" position.

As used herein, "oar lock" refers to a device used to hold an oar in place and as a fulcrum in rowing. The oar lock can be attached to the top edge of the side of the boat, or "gunwale", or in a preferred embodiment, is attached to outriggers which can rotate into the boat for storage.

SUMMARY OF THE INVENTION

The present invention overcomes the drawbacks of existing forward facing rowing apparati and methods by decreasing the need for the rower to utilize both a push and a pull stroke in propelling a boat through the water.

Instead, the "Forward Nile Oar" apparatus and rowing method of the present invention use stretchable, retracting members such as springs or elastic cords (with the ability to store energy) anchored to the boat and to the oars in order to bring the oars back to the "neutral" position once the rower has finished a forward power stroke or reverse power stroke. In the "neutral" position, the forces of the stretchable, retracting members are essentially balanced.

This allows the rower to face forward in his boat, and use his force to push the handles of his oars away from his body, guiding the oar handles along oar range of motion control devices. These actions cause the boat to be propelled forward through the water. The rower then allows the stretchable, retracting members to pull the oars back toward the center or "neutral" position. The rower is similarly able to face forward in his boat and use the present invention to move his boat in reverse by using his force to pull the handles of the oars toward his body, guiding the oar handles along oar range of motion control devices. These actions cause the boat to be propelled through the water in the reverse direction. The rower then allows the stretchable, retracting members to pull the oars back toward the center or "neutral" position.

An alternative embodiment of the present invention utilizes the same apparatus as an exercise machine out of the water. In this embodiment, the apparatus is stabilized by affixing the apparatus to the ground. The rower would move the oars as described herein, however the oars would move through the air as opposed to water as described elsewhere herein.

DETAILED DESCRIPTION OF THE PREFERRED EMBODIMENTS

As described with reference to the accompanying figures, the present invention provides an apparatus and method for rowing that allows the rower to utilize either a forward power stroke or a reverse power stroke and the resulting return stroke returns the oars to the neutral position.

In a preferred embodiment, the invention is implemented with a boat and connected to the side thereof. It is envisioned that the apparatus and method of the present invention can be implemented with any boat a person of ordinary skill in the art would deem suitable and the scope of the present invention is not limited by the type of boat used.

Figure 1:
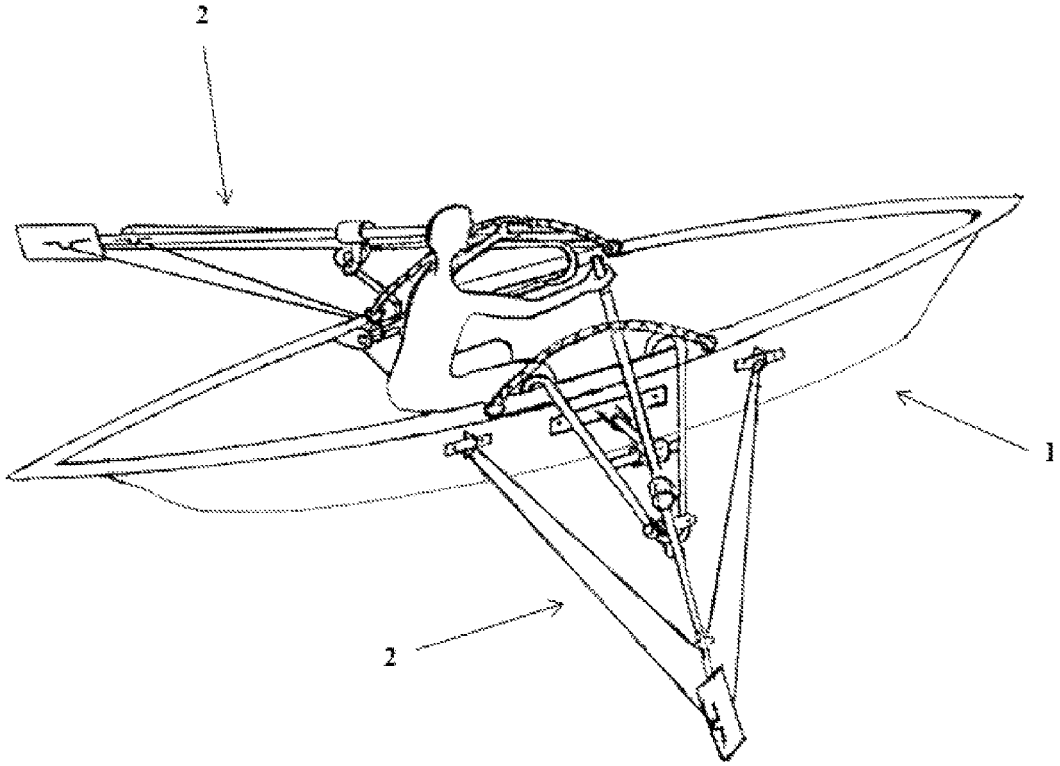
FIG. 1 illustrates the complete "Performance Oar" apparatus.

FIG. 1 illustrates an embodiment of the present invention implemented with a canoe or kayak. An embodiment apparatus of the present invention is attached to the boat 1.

Figure 2:
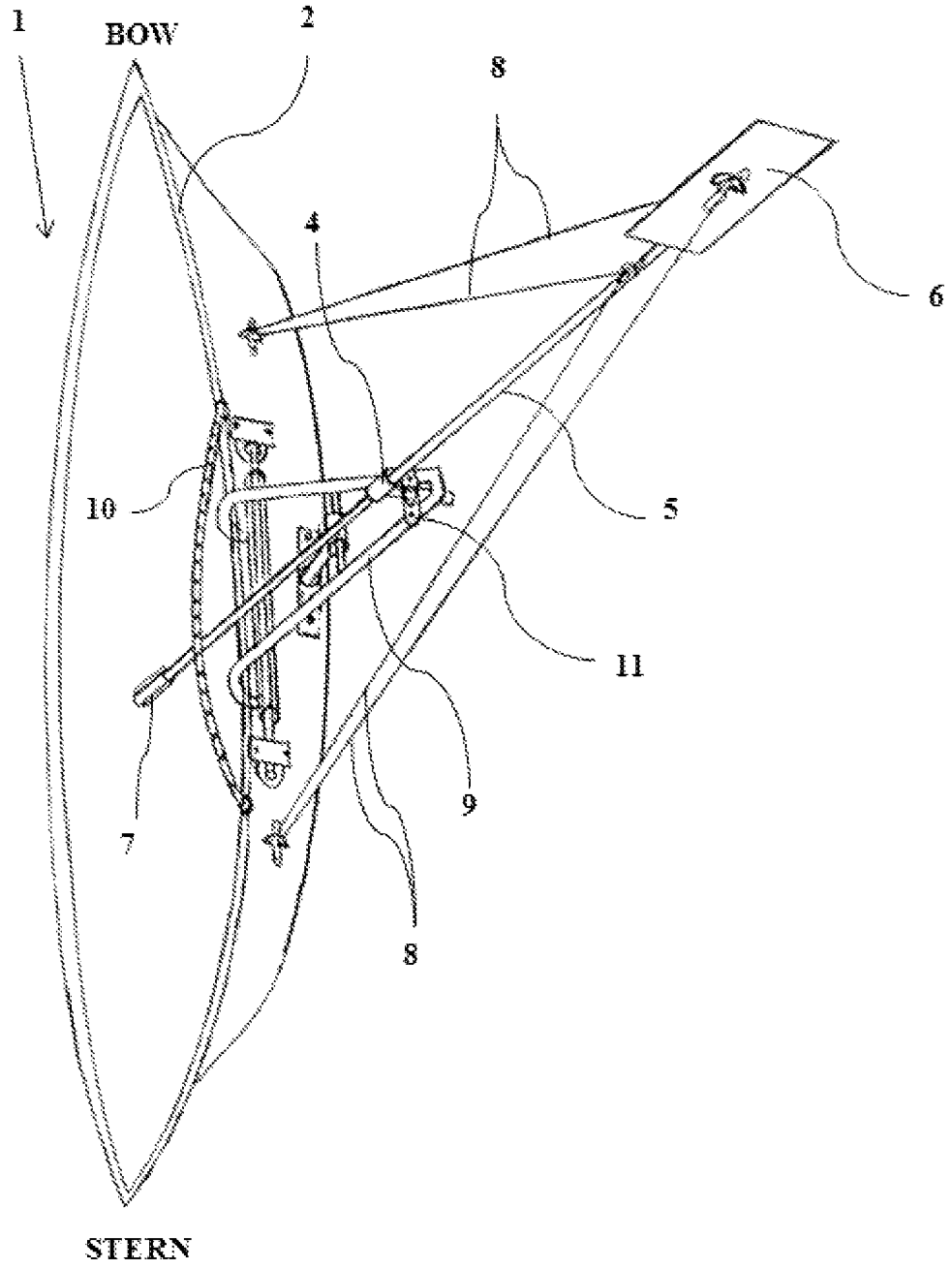
FIG. 2 illustrates one half of an embodiment of the present invention including an attached oar range-of-motion control device.

The apparatus of the present invention is configured as follows with reference to FIG. 2, a preferred embodiment. FIG. 2 shows the starboard half of a preferred embodiment of an apparatus of the present invention, the complete embodiment has a mirror-image configuration on the boat's port side. As detailed in FIG. 2, the apparatus is comprised of an oar 5, an oar lock 4 attached to outriggers 9 which are attached to the gunwale 2 and inside of the boat, and stretchable retracting members 8 which are attached to the oar 5 near the oar blade 6, the oar blade 6, and the outside of the boat (not shown). As shown in FIG. 2, four stretchable, retracting members 8 are attached to connection points (here, U bolts) on the oar shaft and oar blade. In an alternative embodiment, two stretchable, retracting members are used per oar. In such an embodiment, each of the two stretchable, retracting members passes through respective connection points on the oar shaft and oar blade. In such an embodiment, the connection point on the oar shaft can comprise a U bolt or eye bolt and the connection point on the oar blade comprises a small hole (similarly sized to the width of the stretchable, retracting member) in the oar blade. In such an embodiment, the length of the segments of the stretchable, retracting members nearest to the bow and stern of the boat are equal and are controlled by tying knots at the connection points on the oar shaft and oar blade.

In a preferred embodiment, the assembly comprising the oar lock sockets 11 and outriggers 9 can rotate into the boat when not in use, thus increasing the portability and storability of the boat. A more detailed view of the oar lock assembly is shown in FIG. 3.

Figure 3:
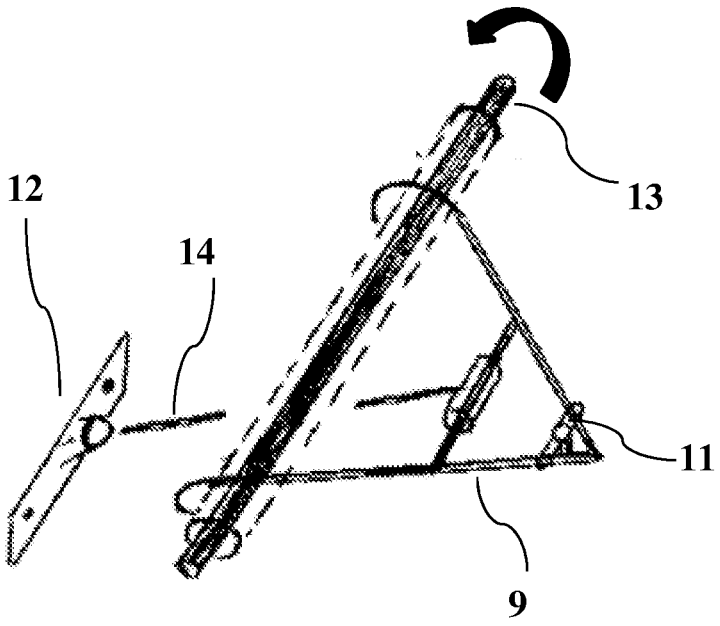
FIG. 3 illustrates the rotatable outrigger assembly.
Figure 5:
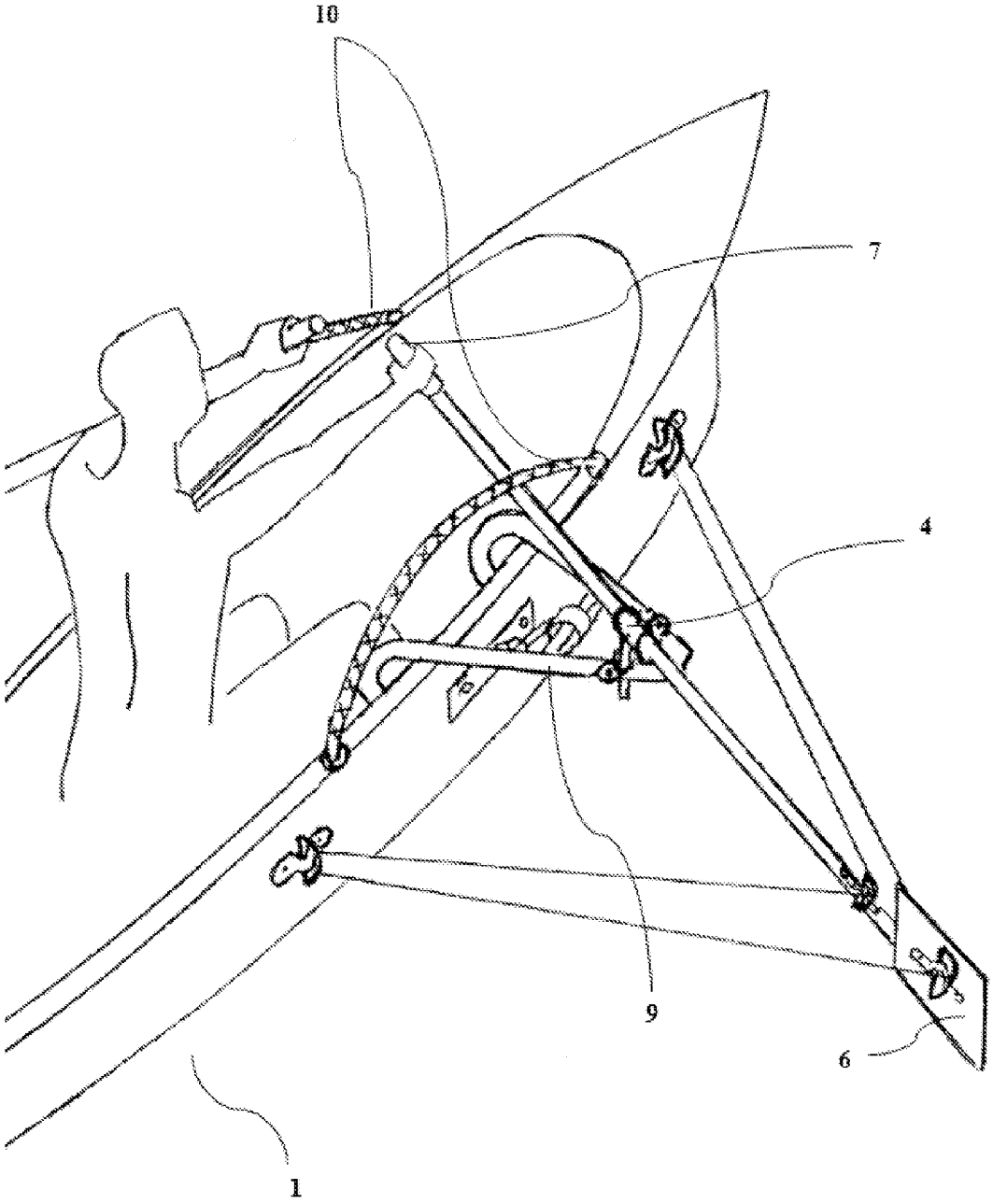
FIG. 5 illustrates one half of an embodiment of the present invention including an attached oar range-of-motion control device.

FIG. 3 is a more detailed depiction of the rotatable outrigger assembly shown in FIG. 2. Not depicted in this figure is the boat, to which support anchor 12 and outrigger rotation shaft 13 are attached. Outrigger rotation shaft 13 can be attached to the inside of the boat as depicted in FIGS. 1 and 5, or more preferably, to the gunwale as depicted in FIG. 2. When attaching the outrigger rotation shaft to either location, adequate space must be given between the shaft and the inside of the boat or the gunwale (as applicable) to allow the curved ends of the outrigger 9 to rotate past the inside of the boat or gunwale (as applicable). An outrigger 9 is attached to an outrigger support member 14. The outrigger support member 14 is attached to an outrigger support anchor 12. The outrigger support anchor 12 is attached to the side of the boat (not shown in this figure). When the outrigger assembly is not being stored in the boat 1, it is supported by the outrigger support member 14 and the outrigger support anchor 12. The outrigger support member 14 can be secured within the outrigger support anchor 12 by a fastening pin (not shown) that connects the support member 14 and the support anchor 12.

The outrigger 9 is rotatably connected to an outrigger rotation shaft 13 around which the entire assembly can rotate into the boat 1. The outrigger rotation shaft 13 is connected to the inside of the boat (not shown) or in a more preferred embodiment, the gunwale 2. To store the outrigger assembly in the boat 1, a user first disconnects the oar lock 4 from the oar lock socket 11. The user then disconnects the outrigger support member 14 from the outrigger support anchor 12. The user can then rotate the entire assembly around the outrigger rotation shaft 13 into the boat 1.

Figure 4:
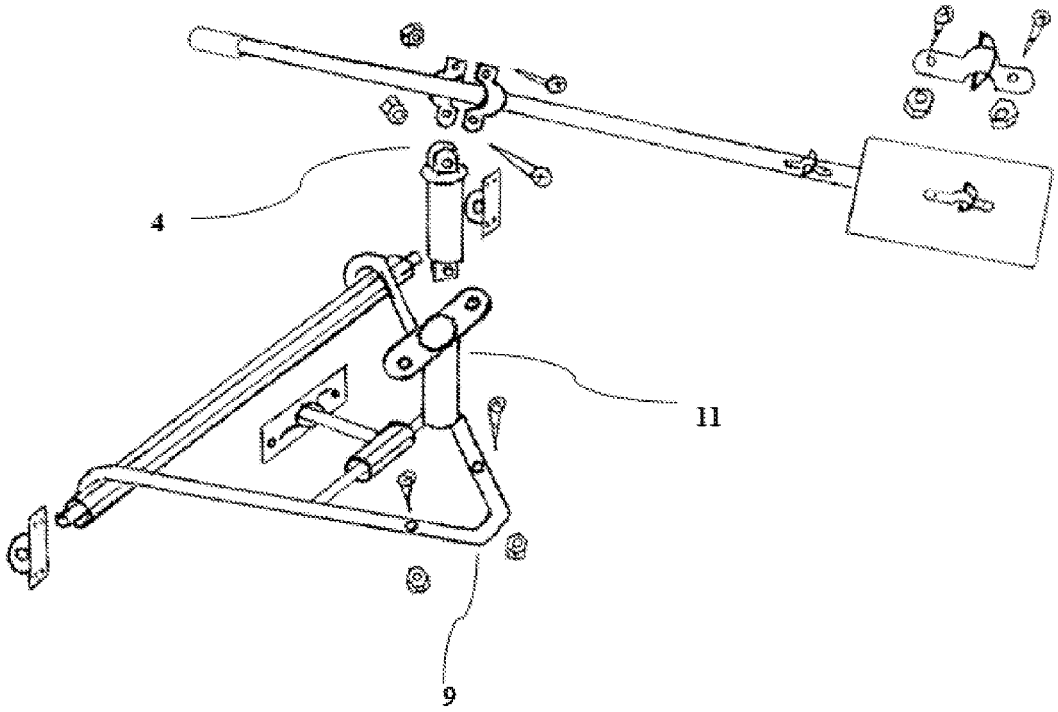
FIG. 4 illustrates a close-up of the associations between the oar lock, the oar lock socket, and the outrigger.

A more detailed depiction of the associations between the oar lock 4, the oar lock socket 11, and the outrigger 9 is show in FIG. 4. In a preferred embodiment, the oar lock socket 11 is affixed to the outrigger 9 with nuts and bolts through holes in the outrigger 9. The oar lock 4 operatively connects to the oar lock socket 11, locking the oars in position during operation of the method of the present invention.

The description that follows provides an example of the method a rower would use to operate the apparatus of the present invention. For illustration purposes, reference is made to FIG. 2, which as explained above, shows only one half of the apparatus of the present invention—the starboard side. For clarity, in the method of the present invention, the description that follows would be simultaneously replicated using the half of the invention attached to the boat's port side.

To operate the embodiment illustrated in FIG. 2, the rower (not shown in FIG. 2) faces the bow of the boat. To move the boat forward (in the direction of the bow), the rower pushes the oar handle 5 away from his body (the forward power stroke) with the oar blade 6 in the water. This causes the oar blade 6 to move toward the boat's stern. This forward power stroke moves the boat forward in the direction of the boat's bow. The forward power stroke releases tension on the stretchable retracting member connected nearer to the boat's stern and increases tension on the stretchable retracting member attached nearer to the boat's bow. The rower then lowers the oar handle 7 which raises the oar blade 6 out of the water. The rower then, while still keeping his hand on the oar handle 7 in order to stabilize the oar 5, allows the stretchable retracting member connected to the boat's bow to release its tension, returning the oar 5 back to its neutral position. The rower then repeats this process to continue moving the boat forward.

To move the boat in reverse (in the direction of the stern), the rower pulls the oar handle 5 toward his body (the reverse power stroke) with the oar blade 6 in the water. This causes the oar blade 6 to move toward the boat's bow. This reverse power stroke moves the boat in reverse (in the direction of the boat's stern). The reverse power stroke releases tension on the stretchable retracting member connected nearer to the boat's bow and increases tension on the stretchable retracting member attached nearer to the boat's stern. The rower then guides the oar handles down by using oar range of motion control devices 10 in a circular direction until the oar blades 6 are out of the water. The rower then, while still keeping his hand on the oar handle 7 in order to stabilize the oar 5, allows the stretchable retracting member connected to the boat's stern to release its tension, returning the oar 5 back to its neutral position. The rower then repeats this process to continue moving the boat in reverse.

In an embodiment, illustrated in FIG. 5, an oar range-of-motion control device 10 limits the range and area of motion covered by the oar. This oar range-of-motion control device 10 can comprise a flexible member such as a length of rope, chain, cable, bungee, or other cord. In another embodiment, the oar range-of-motion control device 10 can comprise a solid member in a curved or rectangular shape. In this embodiment, the solid member can be any rigid material such as metal, plastic, or wood.

As shown in FIG. 5, because of the position of the oar locks 4 attached to the outriggers 9 and the position of the stretchable, retracting members, the oar blades 6 are forced down, into the water and the oar handles 7 are forced up against the range-of-motion control devices 10.

Figure 6:
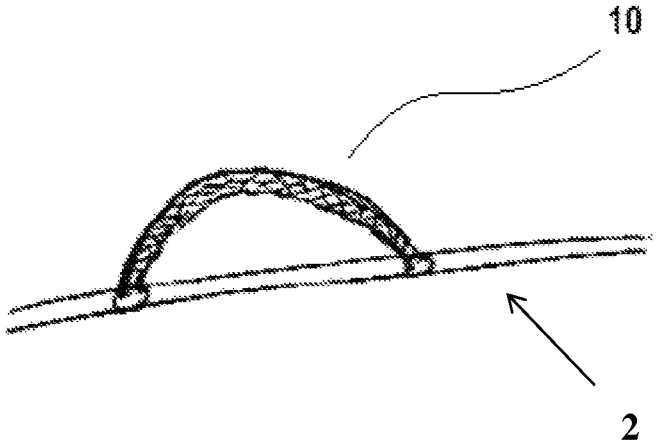
FIG. 6 illustrates a close-up of an oar range-of-motion control device.

FIG. 6 illustrates a close up of an example of an oar range-of-motion control device 10. The surfaces of the range-of-motion control device are smooth enabling the oar to move easily under the device with limited additional friction or resistance. When the oar handles are in motion, the oar range-of-motion control device 10 restricts the oar handles to movements in a half-circle or similar arc.

Figure 7:
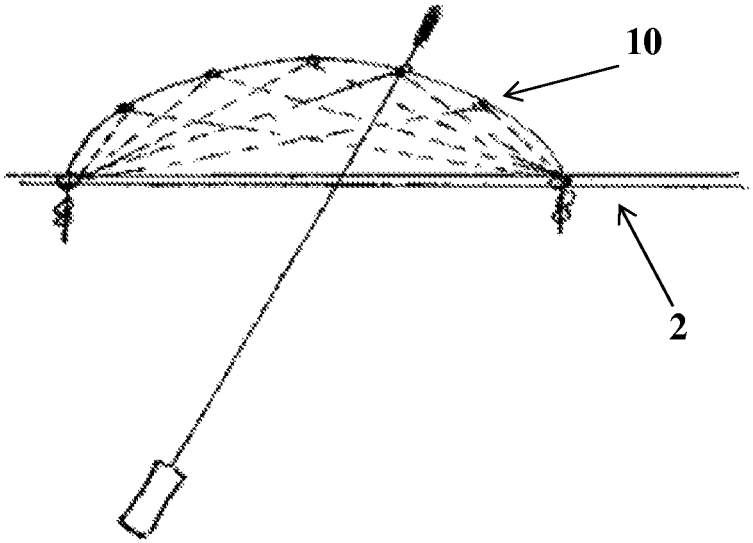
FIG. 7 illustrates a close-up of an oar range-of-motion control device with an oar.

In a preferred embodiment only applicable if the oar range of motion control device is a flexible member, the oar range of motion control device comprises a rope that passed through holes in the gunwale and is secured by "figure 8" knots as shown in FIG. 7. The adjustability of the oar range of motion control device allows the user to control the depth of the oar blade 6 in the water while rowing using the present invention. If the user desires for the oar blades 6 to be positioned deeper in the water, the user can increase the length of the oar range of motion control device.

Using the forward power stroke, the oar handles 7 are pushed along the inside edge of the oar range-of-motion control devices 10 until they reach the forward edges of the oar range-of-motion control devices 10 nearest to the boat's bow. The oar handles 7 are then guided down by motion control devices 10 in a circular direction until the oar blades 6 are out of the water. The rower then allows the stretchable retracting members to pull the oars 5 back to a neutral position.

Using the reverse power stroke, the oar handles 7 are pulled along the inside edge of the oar range-of-motion control device 10 until they reaches the rear edges of the oar range-of-motion control devices 10 nearest to the boat's stern. The oar handles 7 are then guided down by motion control devices 10 in a circular direction until the oar blades 6 are out of the water. The rower then allows the stretchable retracting members to pull the oars 5 back to a neutral position.

Should the rower prefer, the rower can replace the stretchable, retracting members with members of a different resistance. For example, the rower might want increased resistance for sports or physical training exercises, and less resistance for leisurely rowing.

What is claimed is:

1. A method of rowing a boat in a forward direction comprising:

a) moving handles of two oars, each oar pivoting about an oarlock, toward a bow of said boat along inside edges of oar range-of-motion control devices until said oars reach the edges closest to said boat's bow of said oar range-of-motion control devices;

b) guiding the return of the oars to a neutral position with the force of stretchable, retracting members;

c) repeating steps a-b.

2. The method of rowing a boat in a forward direction, as recited in claim 1, further comprising said oaklock being located outside the gunwales of said boat.

3. The method of rowing a boat in a forward direction, as recited in claim 1, wherein each said oar further comprises an oar blade and wherein said stretchable, retracting members attach to each said oar between an oarlock and each said oar blade.

4. A rowing apparatus comprising:

a) a boat;

b) at least a first and a second, but no more than 10, outriggers, each outrigger having a proximal and a distal end, said proximal end of each outrigger connected to the boat;

c) a first oarlock mounted to the distal end of said first outrigger;

d) a first oar, said first oar comprising a handle, a shaft, and a blade, said first oar's shaft removably attached to said first oarlock;

e) a second oarlock mounted to the distal end of said second outrigger;

f) a second oar, said second oar comprising a handle, a shaft, and a blade, said second oar's shaft removably attached to said second oarlock;

g) a first stretchable, retracting member having two ends:

i. a first end attached to said first oar's shaft near said first oar's blade, and ii. a second end attached to said boat on a first side of said boat between said boat's stern and said first outrigger;

h) a second stretchable, retracting member having two ends:

i. a first end attached to said first oar's shaft near said first oar's blade, and ii. a second end attached to said boat on said first side of said boat between said boat's bow and said first outrigger;

i) a third stretchable, retracting member having two ends:

i. a first end attached to said first oar's blade, and ii. a second end attached to said boat on said first side of said boat between said boat's stern and said first outrigger;

j) a fourth stretchable, retracting member having two ends:

i. a first end attached to said first oar's blade, and ii. a second end attached to said boat on said first side of said boat between said boat's bow and said first outrigger;

k) a fifth stretchable, retracting member having two ends:

i. a first end attached to said second oar's shaft near said second oar's blade, and ii. a second end attached to said boat on a second side of said boat between said boat's stern and said second outrigger;

l) a sixth stretchable, retracting member having two ends:

i. a first end attached to said second oar's shaft near said second oar's blade, and ii. a second end attached to said boat on said second side of said boat between said boat's bow and said second outrigger;

m) a seventh stretchable, retracting member having two ends:

i. a first end attached to said second oar's blade, and ii. a second end attached to said boat on said second side of said boat between said boat's stern and said second outrigger;

n) an eighth stretchable, retracting member having two ends:

i. a first end attached to said second oar's blade, and ii. a second end attached to said boat on said second side of said boat between said boat's bow and said second outrigger.

5. The apparatus of claim 4 further comprising:

a port range of motion control device mounted on the port side of said boat.

6. The apparatus of claim 5 further comprising:

a starboard range of motion control device mounted on the starboard side of said boat.

7. The apparatus of claim 4 wherein the outriggers are rotatably connected to the boat.

8. A method of rowing a boat in a forward direction comprising:

a. moving handles of two oars, each oar pivoting about an oarlock, toward a bow of said boat, thereby causing a shaft of each oar to travel along an inside edge of an oar range-of-motion control device until said shaft of said oar reach the inside edge closest to said boat's bow of said oar range-of-motion control device;

b. guiding the return of the oars to a neutral position with the force of stretchable, retracting members located outside a hull of said boat;

c. repeating steps a-b.

* * * * *